US011369178B2

(12) United States Patent
Schalla

(10) Patent No.: US 11,369,178 B2
(45) Date of Patent: Jun. 28, 2022

(54) LICE COMB SYSTEM

(71) Applicant: James Schalla, Edmonds, WA (US)

(72) Inventor: James Schalla, Edmonds, WA (US)

( * ) Notice: Subject to any disclaimer, the term of this patent is extended or adjusted under 35 U.S.C. 154(b) by 299 days.

(21) Appl. No.: 16/184,841

(22) Filed: Nov. 8, 2018

(65) Prior Publication Data

US 2019/0133290 A1 May 9, 2019

Related U.S. Application Data

(60) Provisional application No. 62/583,385, filed on Nov. 8, 2017.

(51) Int. Cl.
*A45D 24/30* (2006.01)
*A45D 24/04* (2006.01)

(52) U.S. Cl.
CPC ..... *A45D 24/30* (2013.01); *A45D 24/04* (2013.01)

(58) Field of Classification Search
CPC ..... A45D 20/48; A45D 20/52; A45D 20/525; A45D 24/04; A45D 24/10; A45D 24/32; A45D 24/30; A45D 2200/15; A45D 2200/155; A01M 3/007; A01K 13/002
USPC ..... 132/219, 103, 118, 117, 137, 149, 155, 132/126, 133, 142, 148, 150; 119/626; D30/159; D28/31
See application file for complete search history.

(56) References Cited

U.S. PATENT DOCUMENTS 3,927,684 A * 12/1975 Lam ..... A45D 20/48 132/119.1
5,628,332 A * 5/1997 Debourg ..... A45D 24/30 132/118
6,006,758 A * 12/1999 Thorne ..... A45D 24/30 132/137
6,098,633 A * 8/2000 Pabari ..... A45D 24/30 132/137
7,089,945 B1 * 8/2006 Barge ..... A45D 24/04 119/627
7,107,645 B2 * 9/2006 Bressler ..... A47L 23/12 D4/130
2003/0209210 A1 * 11/2003 Plante ..... A46B 15/0055 119/625
2008/0110471 A1 * 5/2008 Oliver ..... A46D 1/00 132/148
2010/0000559 A1 * 1/2010 Pabari ..... A01K 13/002 132/126
2010/0086577 A1 * 4/2010 Munoz ..... A01N 65/06 424/405
2011/0048439 A1 * 3/2011 Young ..... A45D 24/04 132/126

(Continued)

FOREIGN PATENT DOCUMENTS

FR 2681228 A1 * 3/1993 ..... A45D 24/30

*Primary Examiner* — Tatiana L Nobrega
*Assistant Examiner* — Sarah Woodhouse

(57) ABSTRACT

In one embodiment, A lice removal comb system includes an inner comb and an outer comb. The inner comb may include a row of lice-removing tines and a handle. The outer comb may include a first row of hair-detangling tines, a second row of hair-detangling tines, a handle, and a slot formed in the outer comb, between the first and second rows of hair-detangling tines. The outer comb may be configured to removably receive the inner comb such that the row of lice-removing tines is disposed between the first and the second rows of hair-detangling tines.

10 Claims, 7 Drawing Sheets

(56) References Cited

U.S. PATENT DOCUMENTS

| | | | | |
|---|---|---|---|---|
| 2013/0312780 | A1* | 11/2013 | Rafaeli | A45D 24/30 132/200 |
| 2013/0324802 | A1* | 12/2013 | Makosky | A61B 17/50 600/249 |
| 2016/0262518 | A1* | 9/2016 | Guy-Rabi | A45D 20/48 |
| 2016/0338467 | A1* | 11/2016 | Park | A46D 1/0276 |
| 2018/0255901 | A1* | 9/2018 | Riazor Vilches | A01M 1/2094 |
| 2020/0268124 | A1* | 8/2020 | Kenigsbuch | A45D 24/32 |

* cited by examiner

LICE COMB SYSTEM

CROSS REFERENCE TO RELATED APPLICATIONS

This application claims priority to U.S. Provisional Patent Application, Ser. No. 62/583,385, filed on Nov. 8, 2017, the contents of which are hereby incorporated by reference for all purposes.

BACKGROUND

The present disclosure relates generally to lice combs. In particular, detangling and/or pressure relieving lice combs are described.

Lice have plagued human populations for millennia. Numerous lice removal tools and techniques have been developed over the ages. Common solutions include shampoos and/or fine-tooth combs.

Existing fine-tooth lice combs, however, may be difficult or impossible to run through hair having even very moderate levels of tangling. Thus, the recipient of the combing treatment may experience significant pain. As the recipient is often a child, this makes it significantly more difficult to remove all the lice. Further, the sharp, often metal, tines of prior art lice combs may cause pain when pressed into the scalp of the recipient of the combing treatment. Additionally, existing lice combs generally only remove the lice and/or eggs from the hair, they do not kill the lice.

Thus, there exists a need for lice combs that improve upon and advance the design of known lice combs. Examples of new and useful lice combs relevant to the needs existing in the field are discussed below.

SUMMARY

In one embodiment, A lice removal comb system comprises an inner comb and an outer comb. The inner comb may comprise a row of lice-removing tines and a handle. The outer comb may comprise a first row of hair-detangling tines, a second row of hair-detangling tines, a handle, and a slot formed in the outer comb, between the first and second rows of hair-detangling tines. The outer comb may be configured to removably receive the inner comb such that the row of lice-removing tines is disposed between the first and the second rows of hair-detangling tines.

In one embodiment, the distance between tines in the row of lice-removing tines is from 0.15 to 0.3 mm. In another embodiment, the distance between tines in a row of lice-removing tines is from 0.2 to 0.3 mm.

In one embodiment, the width of a tine in the first row of hair-detangling tines is at least ten times greater than the width of a tine in the row of lice-removing tines.

In one embodiment, the slot is configured to receive the handle of the inner comb. In one embodiment, the slot and handle of the inner comb are configured to mate via a snap fit.

In one embodiment, the handle of the outer comb includes a void configured to allow access to the handle of the inner comb via the void.

DETAILED DESCRIPTION

The disclosed lice comb systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of lice comb systems examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-6 a first example of a lice comb system, system 10, will now be described. System 10 functions to detangle hair while simultaneously removing lice. Additionally, system 10 reduces painful pressure of metal tines on the scalp.

System 10 addresses many of the shortcomings existing with conventional lice combs. For example, the open, rounded tines of the outer comb of system 10 gently detangle hair as the closely spaced, tight tines of the inner comb remove lice. This gentle detangling significantly reduces discomfort for the recipient. Furthermore, the rounded tips of the tines of the outer comb contact the scalp of the recipient, thereby preventing the sharp tips of the inner tines from digging into the scalp of the recipient. This further reduces discomfort to the recipient.

In some embodiments, the tines of the inner comb may be heated to a sufficient temperate to kill the lice as they are removed from the hair of the recipient. This prevents the spreading and/or recurrence of the lice infestation.

Figure 1:
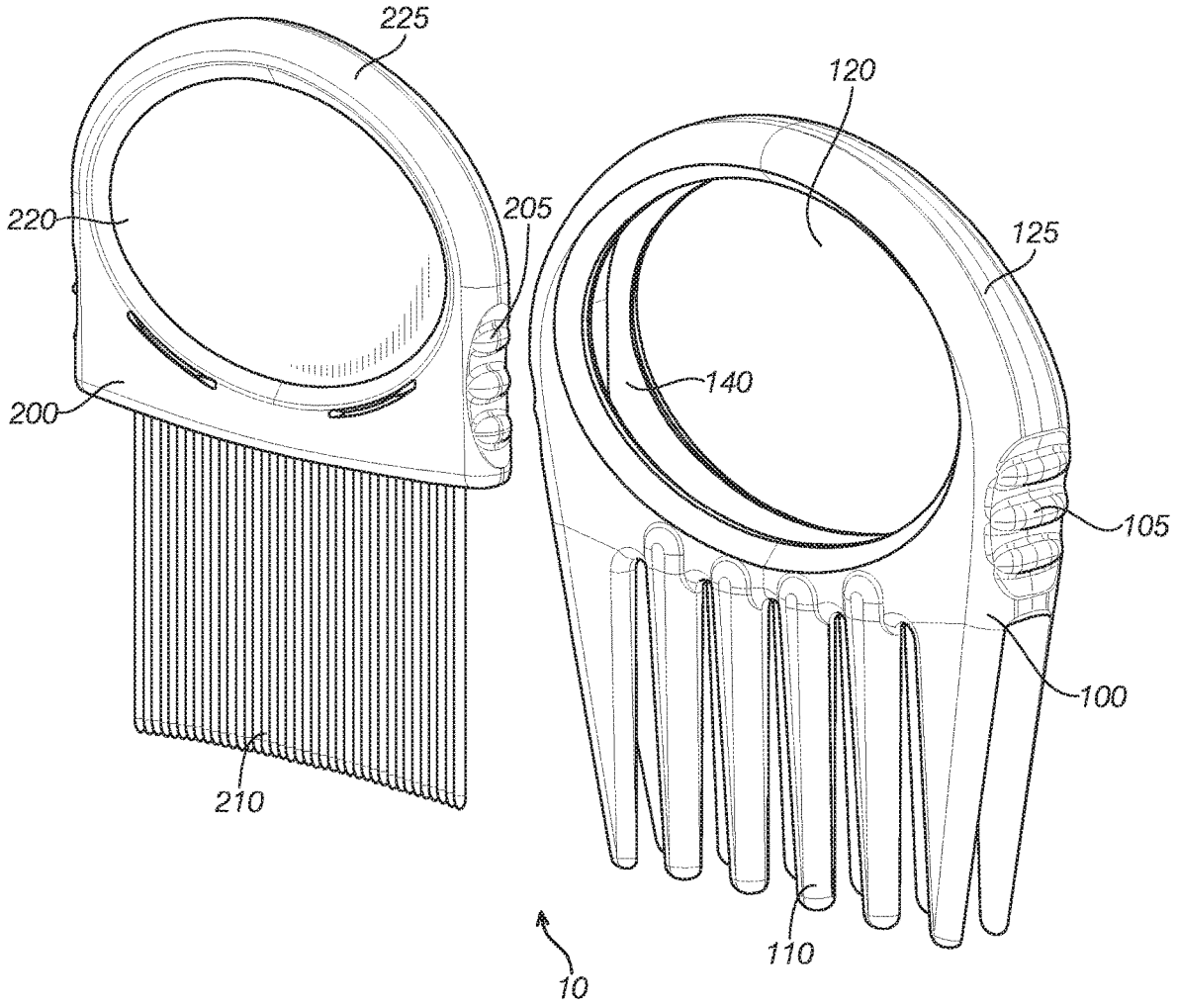
FIG. 1 is a front perspective view of a first example of a lice comb system showing the inner comb and the outer comb.

As shown in FIG. 1, system 10 includes outer comb 100 and inner comb 200. In other examples, the system may include a heating element, one or more temperatures sensors, and a control system to maintain a sufficient temperature to kill lice.

Figure 2:
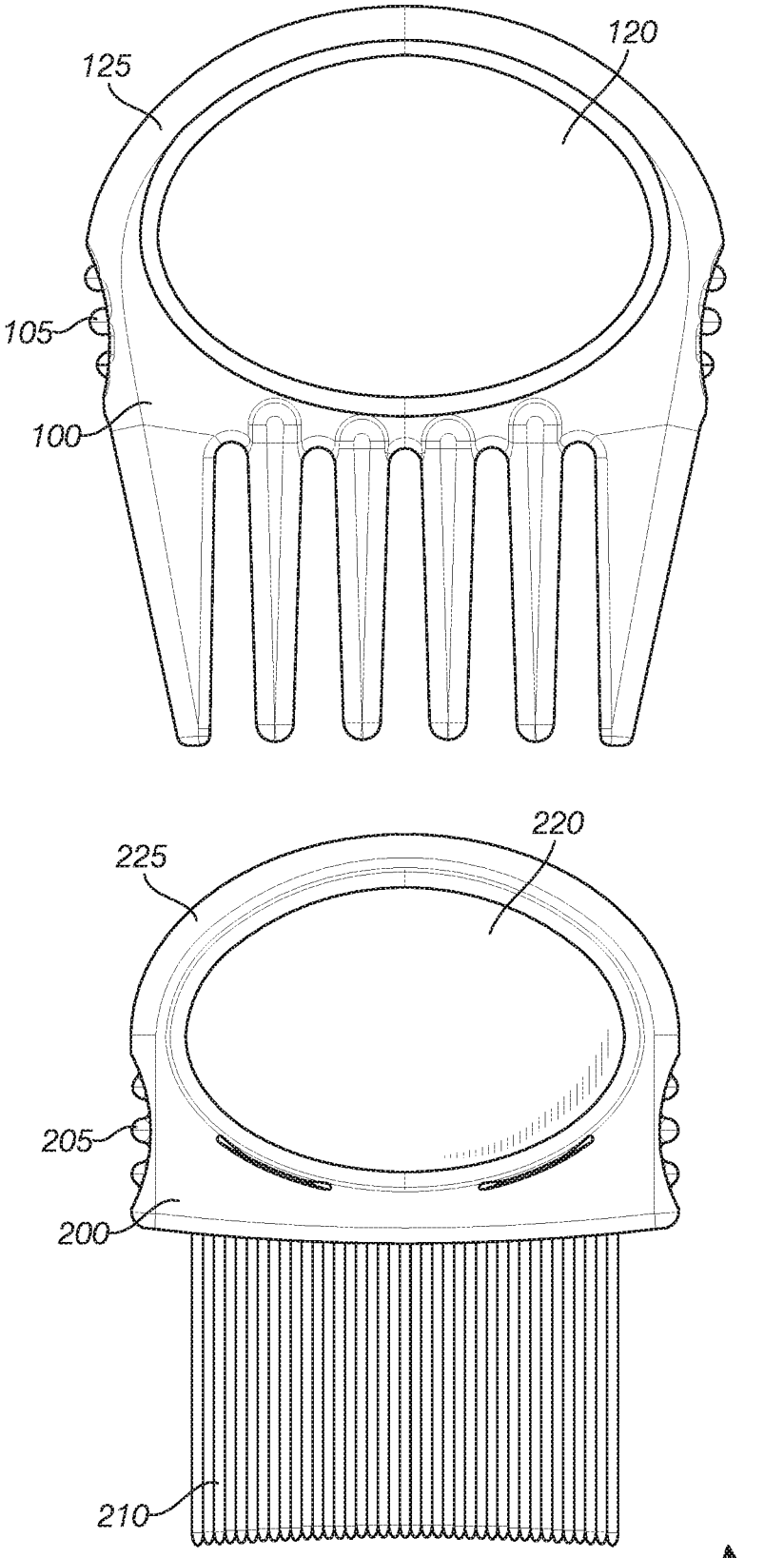
FIG. 2 is a front perspective view of the lice comb system shown in FIG. 1.

As can be seen in FIGS. 1-2, outer comb 100 has a unitary body comprising first and second lateral sides and a top convex side disposed between the first and second lateral sides, wherein the top convex side defines the proximal end of the outer comb, and a longitudinal axis extends between the proximal and a distal end of the outer comb. The outer comb 100 includes a first and second row of hair detangling tines 110. Tines 110 may be rounded having a width at least 10 times larger than the width of tines of the inner comb 200. The row(s) of tines 110 may be spaced apart from each other in a relatively open pattern. In some embodiments, the space between each tine 110, measured at the distal tip of the tine, may be at least the width of one of the tines 110. In some embodiments, the space between each tine 110 in a row of tines may be at least twice the width of one of the tines 110. Thus, the shape and spacing of tines 110 of outer comb 100 may be optimized to gently detangle hair.

Outer comb 100 may also include a handle 125 and a slot 140. The handle 125 may include grip ridges 105. The handle 125 may have a void 120 to facilitate handling of the outer comb 100. Void 120 may be oval, as shown, or it may be any other shape, such a circular, rectangular, irregular, etc. Outer comb 100 may be comprised of a plastic, metal, ceramic, wood, composite and combinations thereof. In the illustrated embodiment, outer comb 100 is comprised of a plastic material.

Slot 140 (best shown in FIG. 5) may be formed in the middle of outer comb 100. Slot 140 may be configured to receive and snugly hold inner comb 200. In some embodiments, the inner comb 200 may slide inside outer comb 100. The outer comb 100 may engage with the inner comb via a snap-fit once the inner comb 200 has been fully seated in the outer comb 100

Inner comb 200 includes a row of tines 210. Inner tines 210 may be of significantly smaller width and more closely spaced than outer tines 110. The space between each inner tine 210 may be less than the width of one of the inner tines 210. In one embodiment, the distance between tines in the row of lice-removing tines is from 0.15 to 0.3 mm. In another embodiment, the distance between tines in a row of lice-removing tines is from 0.2 to 0.3 mm.

Inner tines 210 may have sharp points at the ends of the tines. Thus, inner tines 210 may be configured to remove lice from hair by scraping the eggs and lice from the individual strands of hair.

Inner comb 200 has a proximal end and an opposing distal end wherein a longitudinal axis extends between the proximal and distal ends, wherein the inner comb is a unitary body and may also include an inner comb handle portion 225 disposed at the proximal end of the inner comb. Inner comb 200 may be comprised of a plastic, metal, ceramic, wood, composite and combinations thereof. In the illustrated embodiment, tines 210 of inner comb 200 are comprised of metal and handle 225 is comprised of a plastic material. The inner comb handle portion 225 has a bottom side extending between first and second lateral sides, a top convex side, opposite the bottom side and extending between the first and second lateral sides and opposing first and second continuous surfaces disposed between and bounded by the first and second lateral sides and the top and bottom sides, wherein the first and second lateral sides each comprise a concavity and may include grip ridges 205 within each of the concavities for placement of a user's fingers, wherein the inner comb handle portion has a convexly rounded panel 220 disposed on each of the first and second continuous surfaces to facilitate handling of the inner comb 200. The rounded panels are symmetric about a second axis, perpendicular to the longitudinal axis, and a row of lice-removing tines extending from the bottom side of the inner comb handle portion, wherein tip portions of the lice-removing tines disposed opposite the bottom side define the distal end of the inner comb. Panel 220 may be oval, as shown, or it may be any other shape, such a circular, rectangular, irregular, etc. The shape of panel 220 may match the shape of through-hole 120 such that when assembled, inner comb 200 is snapped into outer comb 100, the through-hole 120 and rounded panels 220 line up, the row of lice-removing tines is disposed between the first and the second rows of hair-detangling tines, the bottom surface of the inner comb handle portion occupies a portion of the slot defined by the bottom surface of the outer comb handle portion, the plurality of grip ridges of the outer comb are aligned with and disposed over the plurality of grip ridges of the inner comb and the rounded panels are received within the through-hole and do not protrude beyond the front and rear surfaces of the outer comb handle portion. When assembled, the first and second lateral sides and the top and bottom sides of the outer comb handle portion, and the rounded panels of the inner comb handle portion cooperatively define a handle of the lice removal comb system such that the rounded panel is accessible through the through-hole.

Figure 3:
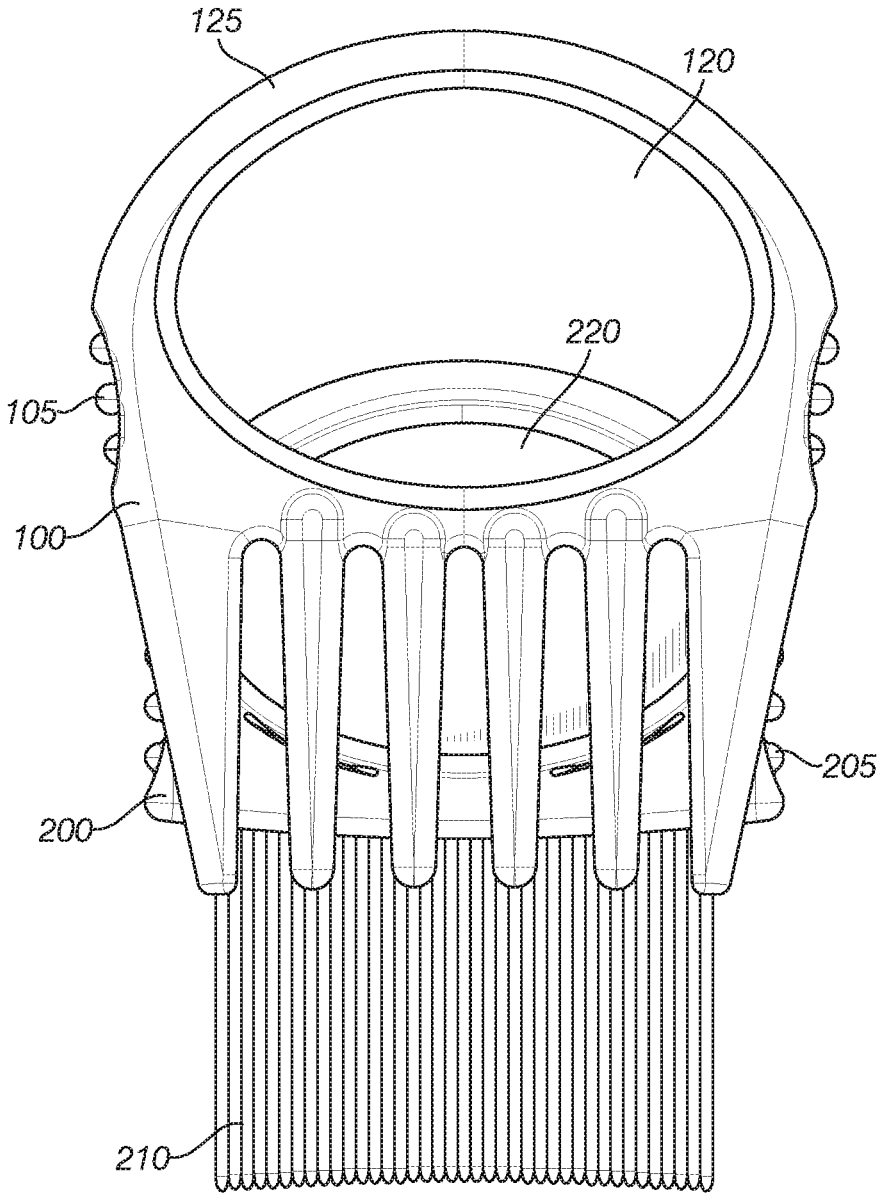
FIG. 3 is a front perspective view of the lice comb system of FIG. 1, showing the outer comb sliding over the inner comb.
Figure 4:
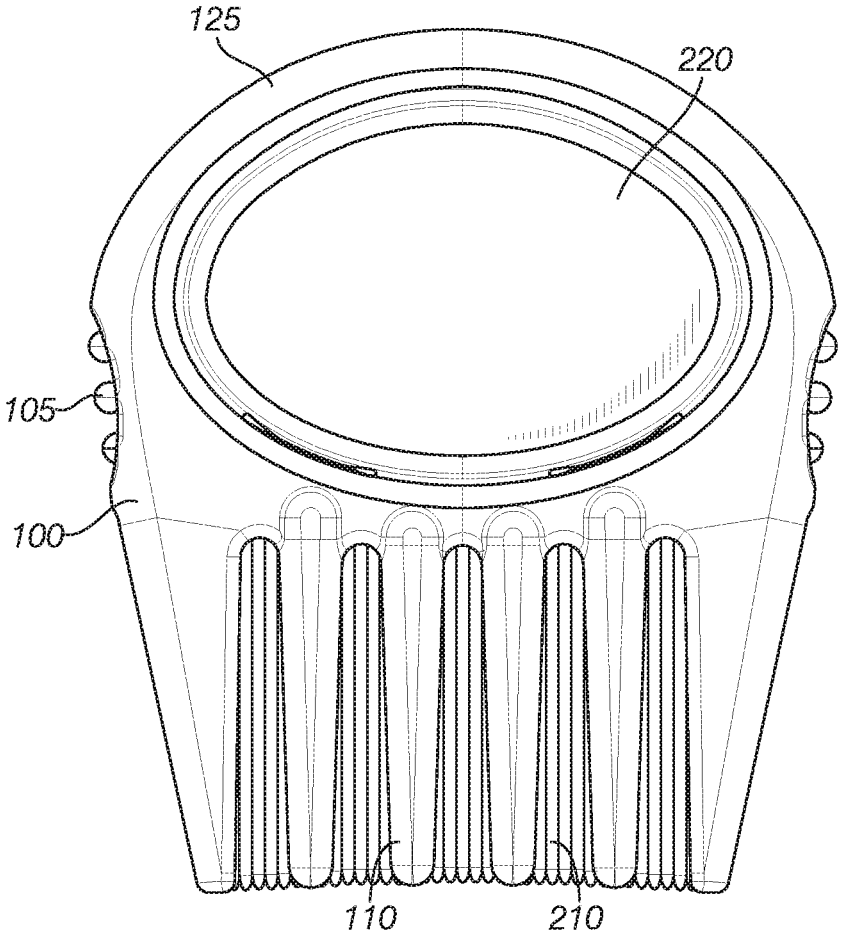
FIG. 4 is a front view of the lice comb system of FIG. 1, showing the system fully assembled with the outer comb enveloping the inner comb.

As shown in FIGS. 1-2, inner comb 200 may be slid into outer comb 100 to form the assembled lice comb system 10. As described above, the inner comb 200 may form a snap-fit with outer comb 100. FIG. 3 shows the assembled lice comb system 10.

As can be seen in FIG. 3 a row of open rounded outer tines 110 is disposed above the row of closely spaced inner tines 210. Thus, as the system 10 is pulled through the hair of the recipient, strands of hair are first funneled through the detangling outer tines 110 for a then through the de-lousing inner tines 210. In those embodiments with a second row of outer tines 110 on the opposite side of the inner tines as the first row, such as the embodiment pictured in pictured, the hair is submitted to an additional detangling treatment via the second row of outer tines. Thus, at least some of the discomfort associated with conventional lice combs may be avoided.

Furthermore, the tips of the outer tines 110 are aligned or nearly aligned with the tips of the inner tines in the y direction. Thus, as the system 10 is dragged across the scalp of the recipient, the rounded tips of the outer tines 110 prevent the sharp tips of the inner tines 210 from digging into the scalp, thereby preventing discomfort associated with conventional lice combs.

In other embodiments (not shown), the inner tines may be attached to the inner comb via one or more springs. The one or more springs may function to allow the inner tines to move vertically in order to closely track the contours of the scalp.

As can be seen in FIG. 3, in the assembled lice comb system 10, the void 120 and panel 220 line up to form a handle.

Figure 5:
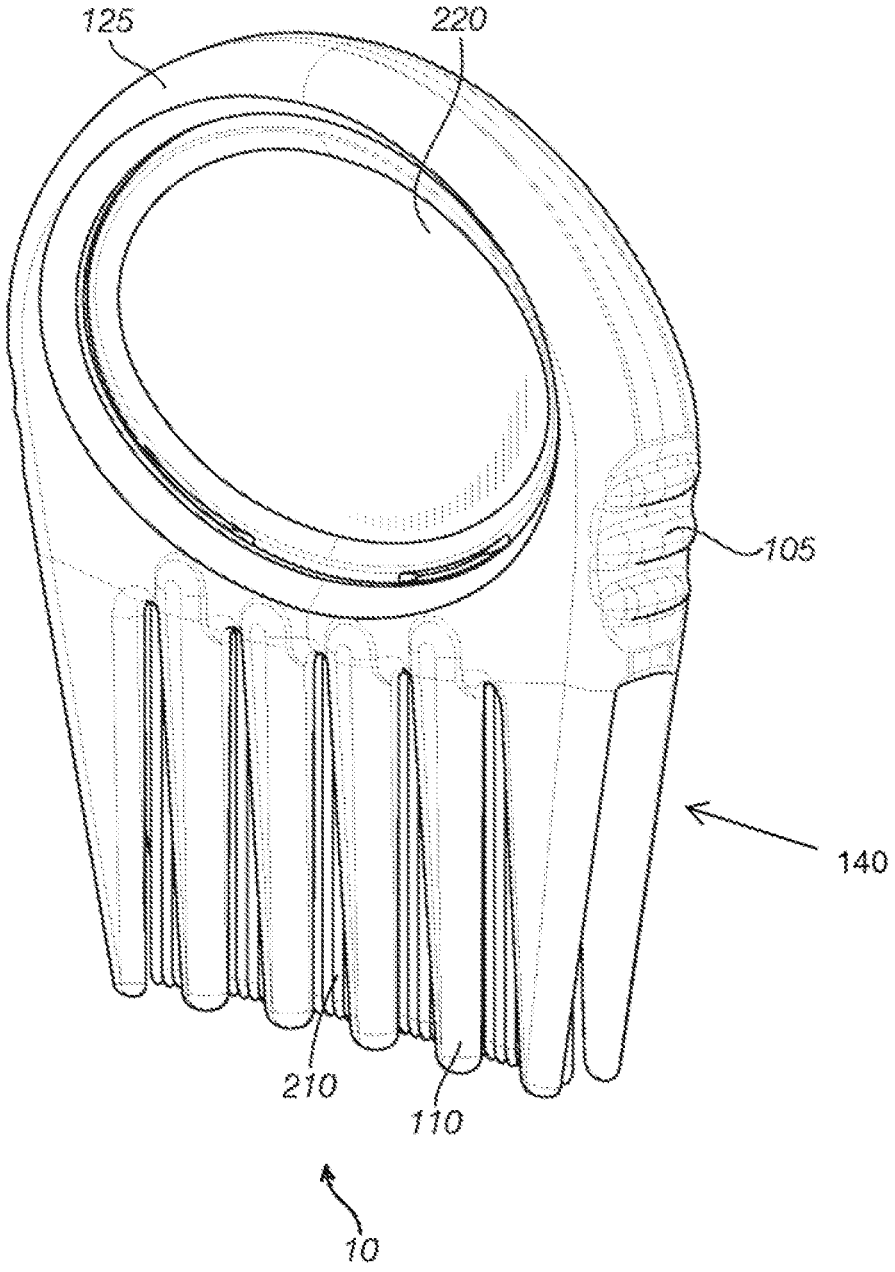
FIG. 5 a front perspective view of the lice comb system of FIG. 1, showing the system fully assembled with the outer comb enveloping the inner comb.

Turning now to FIG. 5, a side view of the outer comb 100 is shown. Outer comb 100 includes slot 140. Slot 140 is configured to accept inner comb 200.

Figure 6:
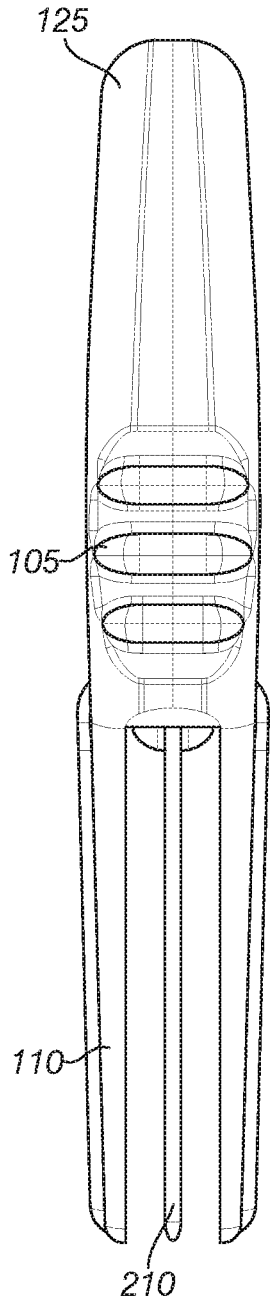
FIG. 6 is a side view of the outer comb.

Turning now to FIG. 6, a bottom view of the system 10 is shown. As can be seen, a row of inner tines 210 is disposed between two rows of outer tines 110. In the embodiment shown, the rows of tines of the inner and outer combs 100, 200 are generally straight lines. In other embodiments, the comb may have a different contour. For example the rows of tines may be concave, convex, or sinusoidal, among others.

In the embodiment shown, the inner tines 210 are configured to remove lice while the outer tines 110 are configured to detangle hair. In other embodiments, this arrangement may be reversed, i.e., the inner tines may be configured to detangle and the outer tines may be configured to remove lice.

Figure 7:
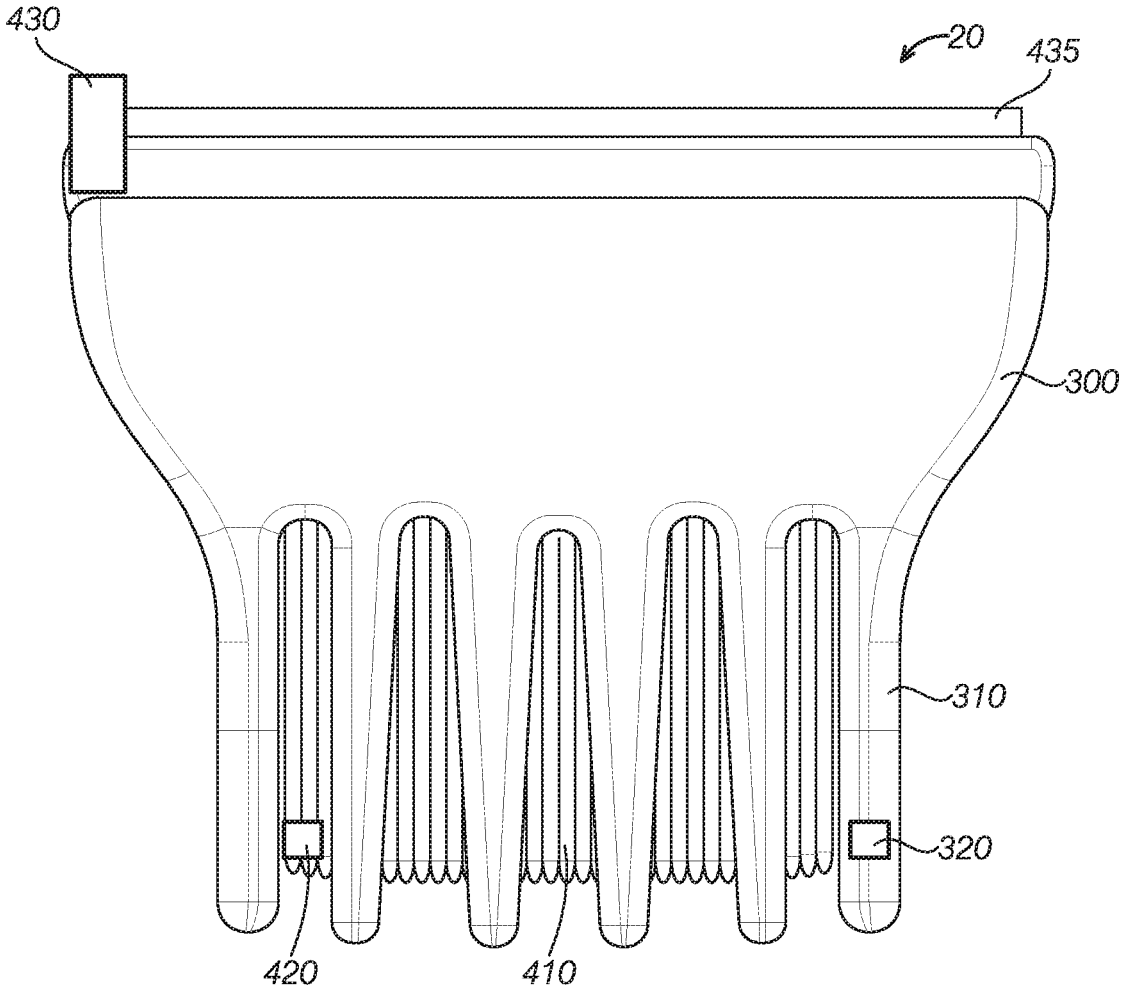
FIG. 7 is a front view of a second example of a lice comb system, including heated tines.

Turning now to FIG. 7 a second example of a lice comb system, system 20 will now be described. System 20 includes many similar or identical features to system 10. Thus, for the sake of brevity, each feature of system 20 will not be redundantly explained. Rather, key distinctions between system 20 and system 10 will be described in detail and the reader should reference the discussion above for features substantially similar between the two systems.

As can be seen in FIG. 7, system 20 includes inner tines 410 and outer tines 310. In addition, system 20 includes temperature sensors 320 and 420, heating element 435 and controller 430. Heating element 435 may heat the base of the inner tines 410. The heat may be conducted along the length of the inner tines 410. The temperature sensors 420, 320 may sense the temperature of the heated inner tines. The temperature sensors 420, 320 and the heating element 435 are in electronic communication with the controller 430. The temperature sensors 420, 320 may transmit temperature data to the controller 430. The controller may modulate the heating element in response to the temperature data.

In some embodiments, the controller may be configured to maintain the temperature of the inner tines 410 to a minimum temperature in order to kill lice as they are collected. In one embodiment, the minimum temperature may be at least 135 degrees Fahrenheit.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A lice removal comb system comprising:

an inner comb having a proximal end and an opposing distal end wherein a longitudinal axis extends between the proximal and distal ends, wherein the inner comb is a unitary body comprising:

an inner comb handle portion, disposed at the proximal end of the inner comb, the inner comb handle portion having a bottom side extending between first and second lateral sides, a top convex side, opposite the bottom side and extending between the first and second lateral sides and opposing first and second continuous surfaces disposed between and bounded by the first and second lateral sides and the top and bottom sides, wherein the first and second lateral sides each comprise a concavity and a plurality of grip ridges disposed within each of the concavities for placement of a user's fingers, wherein the inner comb handle portion has a convexly rounded panel disposed on each of the first and second continuous surfaces, wherein the rounded panels are symmetric about a second axis, perpendicular to the longitudinal axis, and a row of lice-removing tines extending from the bottom side of the inner comb handle portion, wherein tip portions of the lice-removing tines disposed opposite the bottom side define the distal end of the inner comb; and a unitary body outer comb, having first and second lateral sides and a top convex side disposed between the first and second lateral sides, wherein the top convex side defines the proximal end of the outer comb, each of the first and second lateral sides comprising a concavity, each concavity comprising a plurality of grip ridges for placement of a user's fingers, wherein a longitudinal axis extends between the proximal end and a distal end of the outer comb, and comprising:

an outer comb handle portion defined by the top convex side, an opposing bottom side and portions of the first and second lateral sides having the concavities and grip ridges, the outer comb handle portion having opposing front and rear surfaces bound by the first and second lateral sides and the top and bottom sides, the outer comb handle portion having a through-hole extending from the front surface to the rear surface and defining a perimeter, wherein the outer comb handle and the through-hole are symmetric about the longitudinal axis;

a first row of hair-detangling tines extending distal from the bottom side and front surface of the outer comb handle portion;

a second row of hair-detangling tines extending distally from the bottom side and rear surface of the outer comb handle portion, wherein the first and second rows of hair-detangling tines each include a first tooth defining a distal portion of the first lateral side and a last tooth defining a distal portion of the second lateral side;

a slot disposed in an interior portion of the outer comb, the slot extends about the perimeter of the through-hole, through the bottom side of the outer comb handle portion and between the first and second rows of hair-detangling tines such that the slot is in communication with the through-hole; and, wherein the perimeter of the through hole extends from at least a portion of the first tooth to at least a portion of the last tooth and from the top side to the bottom side, wherein the outer comb is removably coupled to the inner comb handle portion of the inner comb by engaging the rounded panels with the slot such that when assembled: i) the row of lice-removing tines is disposed between the first and the second rows of hair-detangling tines ii) the bottom surface of the inner comb handle portion occupies a portion of the slot defined by the bottom surface of the outer comb handle portion iii) the plurality of grip ridges of the outer comb are aligned with and disposed over the plurality of grip ridges of the inner comb and v) the rounded panels are received within the through-hole and do not protrude beyond the front and rear surfaces of the outer comb handle portion, wherein the first and second lateral sides and the top and bottom sides of the outer comb handle portion, and the rounded panels of the inner comb handle portion cooperatively define a handle of the lice removal comb system such that the rounded panel is accessible through the through-hole.

2. The system of claim 1, wherein the distance between tines in the row of lice-removing tines is from 0.15 to 0.3 mm.

3. The system of claim 1, wherein the distance between tines in a row of lice-removing tines is from 0.2 to 0.3 mm.

4. The system of claim 1, wherein the width of a tin the first row of hair-detangling tines is at least ten times greater than the width of a tine in the row of lice-removing tines.

5. The system of claim 1 wherein the slot and the inner comb handle portion of the unitary body inner comb are configured to mate via a snap fit.

6. The system of claim 1, wherein a dimension of the void is the same as a dimension of the panel, and wherein the void and the panel line up after the inner comb has been received into the slot of the outer comb.

7. The system of claim 1, wherein the void and the panel line up after the inner comb has been received into the slot of the outer comb.

8. The system of claim 1, wherein the panel does not have a panel void corresponding to the void of the outer comb.

9. The system of claim 1, wherein tips of the first row of hair-detangling tines and the second row of hair-detangling tines of the outer comb are rounded, wherein tips of the lice-removing tines of the inner comb are sharp, and wherein the rounded tips of the first row of hair-detangling tines and the second row of hair-detangling tines come into contact with a scalp of a recipient to prevent the sharp tines of the lice-removing tines of the inner comb from digging into the scalp of the recipient.

10. The system of claim 1, wherein each of the lice-removing tines of the inner comb are attached to the inner comb using a spring, wherein the springs allow the respective tine to move vertically to track the contours of a scalp of the recipient.

* * * * *